United States Patent [19]

Yamato et al.

[11] 4,451,212

[45] May 29, 1984

[54] PUMPING SYSTEM FOR OIL PRODUCTION

[75] Inventors: Isao Yamato; Tominori Yamada, both of Tamano, Japan

[73] Assignee: Mitsui Engineering & Shipbuilding Co. Ltd., Tokyo, Japan

[21] Appl. No.: 318,981

[22] Filed: Nov. 6, 1981

[30] Foreign Application Priority Data

Nov. 17, 1980 [JP] Japan ..... 55-160752
Dec. 30, 1980 [JP] Japan ..... 55-187412

[51] Int. Cl.[3] ..... F04B 47/08

[52] U.S. Cl. ..... 417/313; 92/159; 92/162 P

[58] Field of Search ..... 92/159, 160, 162 P, 92/162 R; 417/313, 403

[56] References Cited

U.S. PATENT DOCUMENTS

| | | | |
|---|---|---|---|
| 1,597,161 | 8/1926 | Kellogg et al. | 92/160 X |
| 1,817,659 | 8/1931 | Weaver | 92/112 |
| 2,371,846 | 3/1945 | Ruthven | 92/160 X |
| 2,567,513 | 9/1951 | Haines | 417/313 X |
| 2,764,940 | 10/1956 | Long | 417/313 X |
| 2,821,141 | 1/1958 | Sargent | 417/403 |
| 3,098,452 | 7/1963 | Davis | 417/313 X |
| 3,295,452 | 1/1967 | Smith | 417/403 |
| 3,802,802 | 4/1974 | Greer | 417/313 X |
| 4,383,803 | 5/1983 | Reese | 417/403 X |

*Primary Examiner*—Leonard E. Smith
*Attorney, Agent, or Firm*—Armstrong, Nikaido, Marmelstein & Kubovcik

[57] ABSTRACT

A pumping system for oil production comprises a hydraulic unit set on the ground and adapted to send out a pressure oil, and a pump unit set in an oil well and adapted to draw up crude oil therefrom. The pump unit comprises a pump cylinder, and a plunger reciprocatingly moved in the pump cylinder. The plunger is provided with a clearance formed between the outer circumferential surface of a lower end portion thereof and the inner circumferential surface of the pump cylinder. The pressure oil supplied from the hydraulic unit is ejected from the clearance along the inner surface of the pump cylinder into a cylinder chamber.

2 Claims, 10 Drawing Figures

PUMPING SYSTEM FOR OIL PRODUCTION

BACKGROUND OF THE INVENTION

This invention relates to a pumping system for oil production, and more particularly to a pumping system for oil production, which is suitably used to draw up crude oil above the ground from a heavy-oil well, or an oil well, which has a decreased self-welling power, and which has been subjected to second and third oil production operations to show a tendency to increase in the ratio of quantity of heavy oil.

The problem in the artificial oil production in a heavy-oil well, in which an oil production operation is being carried out, as well as an oil well, which has a decreased self-welling power, and which has been subjected to second and third oil production operations to show a tendency to increase in the ratio of quantity of heavy oil, is that the performance and life of an oil suction pump are spoiled greatly in a very short period of time due to the suspended matter, such as mud and sand, contained in large quantities in the crude oil. Such crude oil as mentioned above generally contains sand, silt, sludge and brine therein, which cause a sliding surface of the pump to be worn and corroded. When the crude oil contains a large amount of paraffin group, the paraffin sticks to the sliding surface of the pump to give rise to trouble. Especially, the wear on and corrosion of the sliding surface of the pump, which are referred to above, pose a very serious problem in a third recovery of crude oil, and cause the life of the oil suction pump to be shortened to a great extent.

SUMMARY OF THE INVENTION

An object of the present invention is to provide a pumping system for oil production, which is suitably used to draw up, especially, heavy oil.

Another object of the present invention is to provide a pumping system for oil production, which permits preventing the sliding surface of the pump from being worn even when it is used for the production of heavy oil, and which can stand a long-term use.

Still another object of the present invention is to provide a pumping system for oil production, which permits reducing the viscosity of heavy oil to be recovered when the heavy oil is sucked into the pump, to improve the fluidity thereof, whereby the heavy oil can be drawn up above the ground very easily.

To achieve the above objects, the present invention provides a pumping system for oil production, which comprises a hydraulic unit set on the ground to send out a high-pressure oil, and a pump unit set in an oil well to draw up the crude oil therefrom. The pump unit comprises a pump cylinder, and a plunger capable of being moved reciprocatingly in the pump cylinder. The plunger consists of an oil reservoir adapted to receive the pressure oil sent from the hydraulic unit thereto, and a clearance formed between that portion of the outer circumferential surface of the plunger which faces the interior of a cylinder chamber and the inner circumferential surface of the pump cylinder, the oil reservoir and clearance being communicated with each other. When the plunger in the above-described structure is reciprocatingly moved in the pump cylinder, the pressure oil is ejected from the clearance into the cylinder chamber along the inner surface of the pump cylinder.

The above and other objects of the present invention will become apparent from the following description of the preferred embodiments taken in conjunction with the accompanying drawings.

DESCRIPTION OF THE PREFERRED EMBODIMENTS

Figure 1:
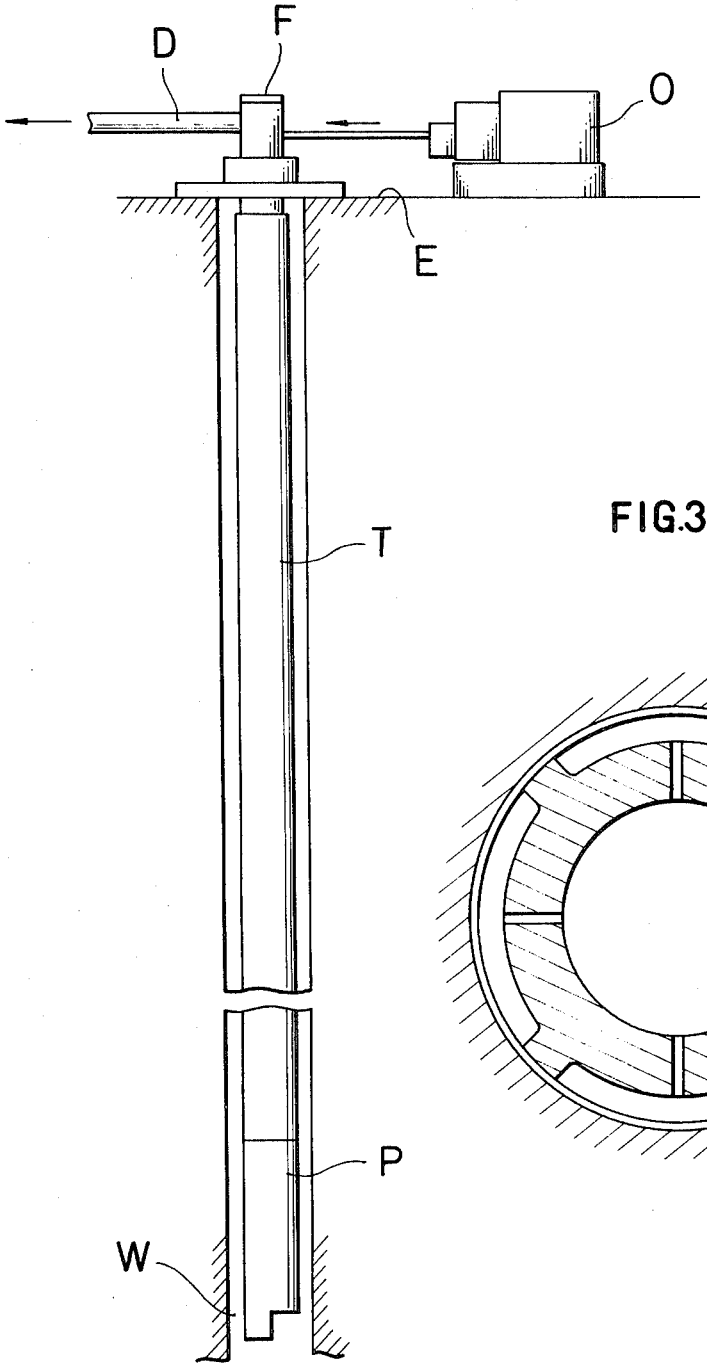
FIG. 1 is a longitudinal sectional view in schematic representation of a pumping system for oil production embodying the present invention.

FIG. 1 shows a pumping system as a whole for oil production according to the present invention. A well head assembly F is set on that portion of the oil well-surrounding area of the ground E which is just above the oil well W, and a hydraulic unit O connected to the well head assembly F is also provided on the oil well-surrounding area of the ground E. A pump unit P connected to the well head assembly F via a tubing T is set in the oil well W. The hydraulic unit O is adapted to feed under a high pressure a lubricating oil, the viscosity of which is lower than that of the crude oil in the oil well W, and send the compressed oil to the pump unit P via the well head assembly F and tubing T. Thus, an oil-sucking operation, which will be described later, is carried out. The crude oil drawn up by the pump unit P is recovered through a pipe D via the tubing T and well head assembly F.

Figure 2:
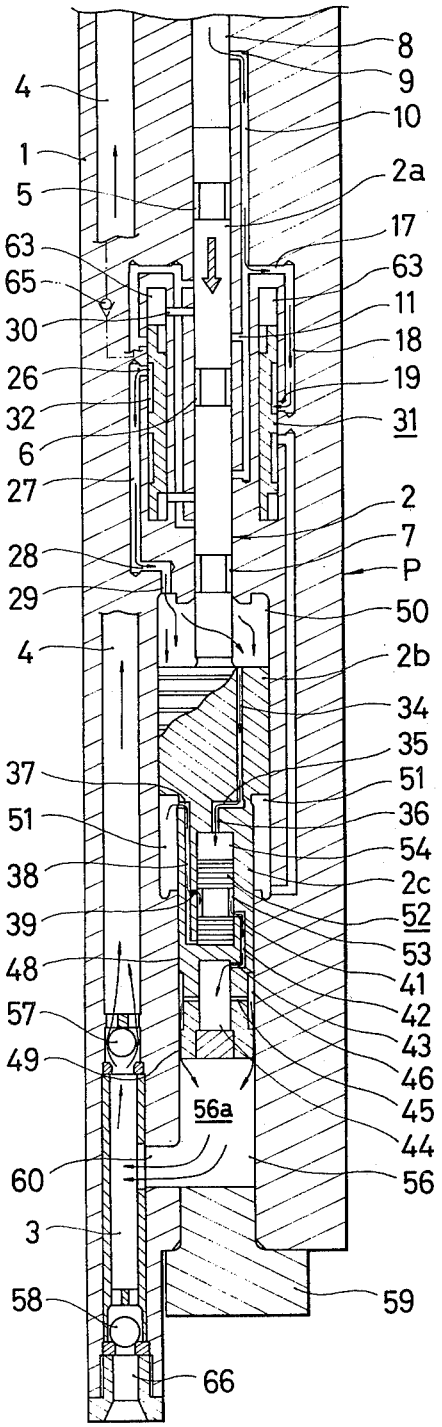
FIGS. 2A–2D are longitudinal sectional views illustrating the details of a pump unit in the pumping system shown in FIG. 1, with respect to various strokes of a plunger provided therein.
Figure 2:
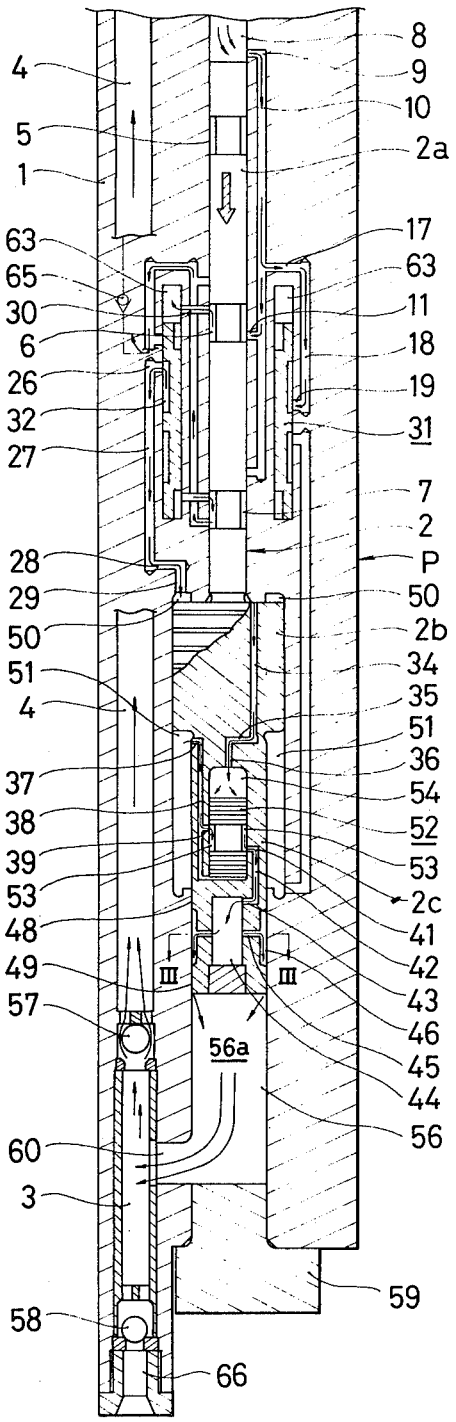
Figure 2:
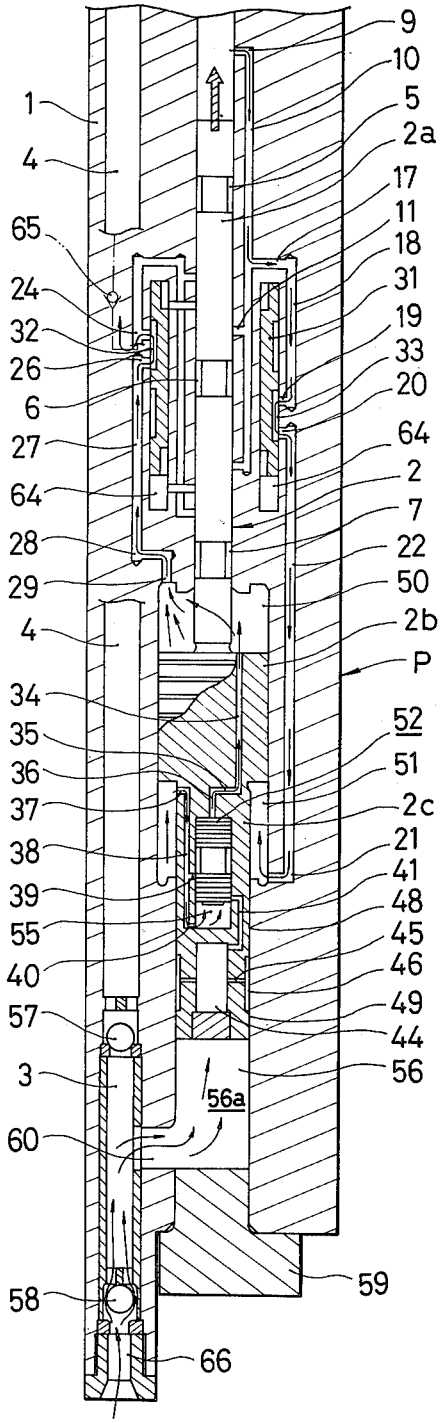
Figure 2:
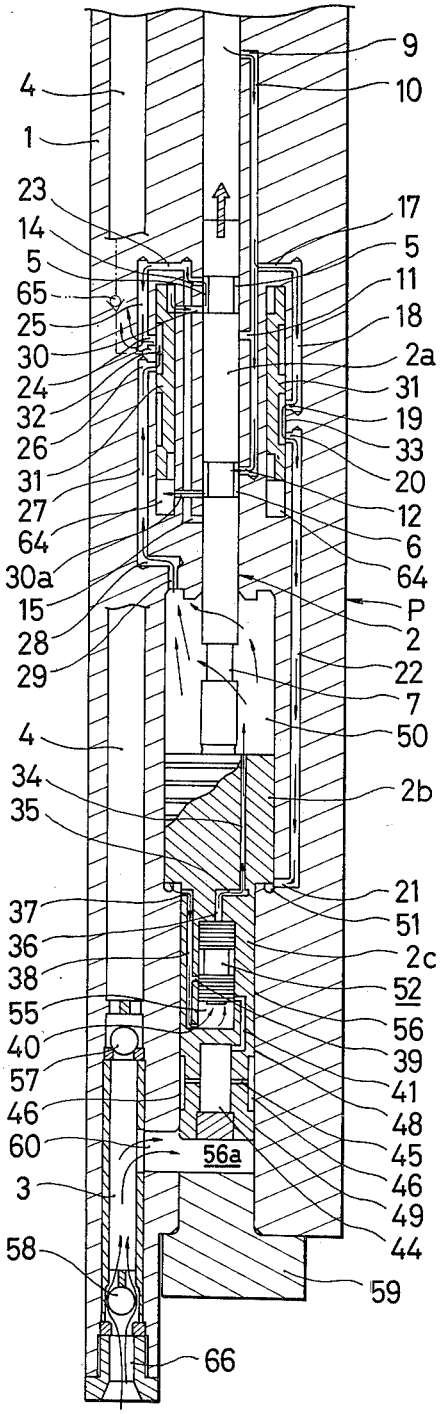

FIGS. 2A–2D show the details of the pump unit P in the above-mentioned pumping system. FIG. 2A shows a main plunger 2 in the pump unit P, which is about to be moved downwardly from the uppermost position, and FIG. 2B the main plunger 2 in an intermediate point of a downward stroke thereof. FIG. 2C shows the main plunger 2, which is about to be moved upwardly from the lowermost position, and FIG. 2D the main plunger 2 in an intermediate point of an upward stroke thereof. The pump unit P is adapted to suck the crude oil from the oil well W into a cylinder chamber **56*a* via a suction port 66 and a suction valve 58, and thereafter discharge the crude oil from the cylinder chamber 56*a* into a crude oil discharge pipe 4 via a discharge valve 57, as the strokes of the plunger 2 illustrated in FIGS. 2A–2D** are repeatedly made.

As shown in FIGS. 2A–2D, the pump unit P consists of a main plunger 2 provided in a pump casing 1 so as to be moved in the vertical direction, a pump cylinder 56 formed in that portion of the pump casing 1 which is under the main plunger 2, a crude oil discharge pipe 4 provided in the pump casing 1 and having a valve chamber 3 communicated with the pump cylinder 56 at a lower end portion of the latter and extending in parallel with the main plunger 2, and a pressure oil passage shifting piston 31 provided in an upper portion of the pump casing 1 so as to be moved in the vertical direction.

Figure 3:
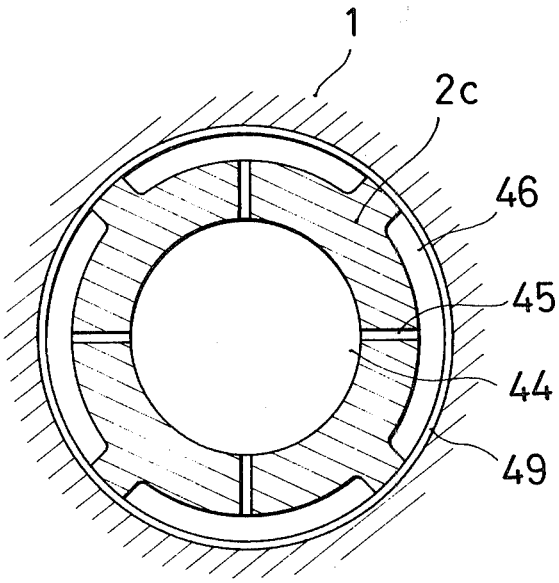
FIG. 3 is a sectional view taken along the line III—III in FIG. 2A.

The main plunger 2 has a slide rod 2*a* constituting an upper portion thereof, a hydraulic piston 2*b* thereunder, and a pump plunger 2*c* under the hydraulic piston 2*b*. The pump plunger 2*c* is provided with a slider 52 in an upper portion of the interior thereof so as to be moved in the vertical direction. The slider 52 is used for the displacement of the pressure oil, and has a stepped portion 53 of a smaller diameter. The pump plunger 2*c* is also provided with an oil reservoir 44 in a lower portion of the interior thereof. The outer circumferential surface of the lower portion of the pump plunger 2*c* is provided with oil dams 46 as shown in FIG. 3, which are spaced from one another. The wall of the lower portion of the pump plunger 2*c* is provided with capillary 45 via which the oil dams 46 are communicated with the oil reservoir 44. The slide rod 2*a* is provided as shown in the drawings with stepped portions 5, 6 and 7 of a smaller diameter, which are adapted to shift pressure oil passages.

Reference numerals 34, 35 and 36 denote pressure oil passages formed in the hydraulic piston 3 constituting a part of the main plunger 2. The passage 34 is communicated with an upper oil chamber 50, and the passage 36 with an upper chamber 54 formed above the slider 52. Reference numerals 37, 38, 39 and 40 denote pressure oil passages formed in the pump plunger 2*c* constituting a part of the main plunger 2. The passage 37 is opened into a lower oil chamber 51, and the passage 39 capable of being opened into the stepped portion 53 (refer to FIG. 2A) of a smaller diameter of the slider 52. The passage 40 is opened into a lower chamber 55 formed under the slider 52. Reference numerals 41, 42 and 43 also denote pressure oil passages. The passage 41 is capable of being opened into the stepped portion 53 of a smaller diameter of the slider 52, and the passage 43 is opened into the oil reservoir 44.

The operation of the pump unit P will now be described.

Referring first to FIG. 2A, a high-pressure oil sent out from the hydraulic unit O illustrated in FIG. 1 is guided into a main pressure oil passage 8 in the pump unit P via the tubing T. The pressure oil then reaches a pressure oil passage 30 via pressure oil passages 9, 10 and 11 provided in the casing 1, and a stepped portion 6 of a smaller diameter provided in the slide rod 2*a* of the main plunger 2. The pressure oil is then guided into an upper oil chamber 63 above the passage shifting piston 31, to cause the same piston 31 to be lowered as shown in the drawing. In the meantime, a part of the pressure oil passing through the pressure oil passages 9 and 10 is guided into an upper recess 32 formed in the outer circumferential surface of the passage shifting piston 31 via other oil passages 17, 18 and 19 branching off from the pressure oil passage 10. The pressure oil is then introduced into the upper oil chamber 50 above the hydraulic piston mentioned above, via pressure oil passages 26, 27, 28 and 29, which are communicated with the upper circumferential recess 32.

As a result, the main plunger 2 begins to be moved downwardly as shown in FIG. 2B. At the same time, the pressure oil introduced into the upper oil chamber 50 is guided into the upper chamber 54 above the slider 52 via the oil passages 34, 35 and 36 to cause the slider 52 to be downwardly moved. The main plunger 2 thus continues to be moved downwardly by the pressure of the pressure oil working on the upper surface of the hydraulic piston 2*b* thereof. The pressure oil in the lower oil chamber 51 under the lower surface of the hydraulic piston 2*b* is introduced into the oil reservoir 44 in the pump plunger 2*c*, which constitutes the lower portion of the main plunger 2, via the pressure oil passages 37, 38 and 39, recess 53 formed in the circumferential surface of the slider 52, and pressure oil passages 41, 42 and 43. The pressure oil then flows into the oil dams 46 via the capillary 45 to be ejected as a high-pressure oil from the clearance 49, which is formed between the outer circumferential surface of the lower portion of the pump plunger 2*c* and the inner circumferential surface of the pump cylinder 56, along the inner circumferential surface of the pump cylinder 56 into the cylinder chamber 56*a*.

Owing to the pressure oil ejected from the circumferential portion of the lower end of the pump plunger, the sand, silt and sludge deposited from the crude oil on the inner circumferential surface of the pump cylinder 56 can be removed effectively, and the outer circumferential surface of the pump plunger 2*c* and the inner circumferential surface of the pump cylinder 56 can be prevented effectively from being worn or corroded due to or with the sand, silt and sludge. The ejected pressure oil of a low viscosity is mixed in the crude oil in the pump cylinder 56 and valve chamber 3 to lower the viscosity thereof. Thus, the fluidity of the crude oil in the crude oil discharge pipe 4, through which the crude oil is drawn out to the ground, is improved, so that the crude oil can be carried out to the ground easily.

While the main plunger 2 continues to be moved downwardly by the pressure of the pressure oil as mentioned above, the suction valve 58 is closed as shown in the drawings with the discharge valve 57 opened. Accordingly, the mixed fluid of crude oil and pressure oil is sent through the crude oil discharge pipe 4 into the well head assembly F set on the ground.

When the main plunger 2 in the pump unit P is moved downwardly to reach the lower limit position as shown in FIG. 2C, the pressure oil passages 14 and 30 are communicated with each other via the stepped portion 5 of a smaller diameter, while the passage 11 is closed. Also, the passages 12 and 30*a* are communicated with each other via the stepped portion 6 of a smaller diameter, while the passage 15 is closed. Consequently, the pressure oil in the upper oil chamber 63 flows into the crude oil discharge pipe 4 through the passage 30, stepped portion 5 of a smaller diameter, passages 14, 23 and 25 and check valve 65. At the same time, the pressure oil is sent into the lower oil chamber 64 to allow the passage shifting piston 31 to be moved upwardly as shown in FIG. 2C. Consequently, the pressure oil passages 29, 28, 27 and 26 communicated with the upper oil chamber 50 above the hydraulic piston 2*b* is opened into the crude oil discharge pipe 4 as shown in FIG. 2C, via the upper circumferential recess 32 in the passage shifting piston 31, passage 24 and check valve 65. At the same time, the pressure oil passages 19 and 20 are communicated with each other via the lower circumferential recess 33 in the passage shifting piston 31. As a result, the pressure oil supplied from the hydraulic unit O is sent into the lower oil chamber 51 under the hydraulic piston 2*b*, through the main pressure oil passage 8 and passages 9, 10, 17, 18, 19, 20, 22 and 21, to press the hydraulic piston 2*b* in the upward direction, so that the main plunger 2 is upwardly moved. At this time, the pressure oil in the upper oil chamber 50 flows into the crude oil discharge pipe 4 via the passages 29, 28, 27 and 26, circumferential recess 32 in the passage shifting piston 31, passage 24 and check valve 65.

The main plunger 2 is thus moved upwardly as shown in FIG. 2D. As the main plunger 2 is upwardly moved, the pressure oil sent into the lower oil chamber 51 as mentioned above is introduced into the chamber 55 under the slider 52 through the passages 37, 38 and 40. As a result, the slider 52 is pressed upwardly to cause the pressure oil in the chamber 54 above the same to be discharged into the upper oil chamber 50 via the passages 36, 35 and 34.

When the slider 52 is moved upwardly as mentioned above, the communication between the passages 39 and 41 is cut thereby. Therefore, while the main plunger 2 is upwardly moved, the ejection mentioned above of the pressure oil from the clearance 49 between the pump plunger 2c and pump cylinder 56 is interrupted.

Needless to say, while the main plunger 2 is upwardly, the pressure in the valve chamber 3 is lowered, so that the suction valve 58 is opened with the discharge valve 57 closed. As a result, the crude oil in the oil well is sucked into the cylinder chamber 56a in the pump cylinder 56.

When the main plunger 2 thus continues to be upwardly moved and reaches the top dead position, it is in the position illustrated in FIG. 2A and referred to in the previous paragraph. The main plunger 2 then starts being moved downwardly again.

The pumping system permits as described above drawing up the crude oil from the oil well while sending a pressure oil from the hydraulic unit O to the pump unit P continuously.

When the pump plunger 2c has become eccentric with respect to the pump cylinder 56 from a certain cause during the downward movement mentioned above of the main plunger 2 to make uneven the clearance 49 between the pump plunger 2c and pump cylinder 56, the rate of ejection of the pressure oil from a widened portion of the clearance 49 becomes greater than that of the pressure oil from a narrowed portion thereof. Consequently, the pressure in an oil dam 46 communicated with the widened portion of the clearance 49 becomes lower than that in an oil dam 46 communicated with the narrowed portion thereof, so that the force for eliminating the eccentricity of the pump plunger 2c is applied thereto automatically. Thus, the eccentricity of the pump plunger 2c is corrected automatically. Accordingly, when the capillary 45, oil dams 46 and clearance 49 are designed suitably, the pump plunger 2c can always be held stably and firmly in the center of the pump cylinder 56. Also, the pressure oil can be ejected at a uniform pressure from the circumferential portion of the pump plunger 2c along the inner circumferential surface of the pump cylinder 56, so that the sand, silt and sludge deposited from the crude oil on the inner circumferential surface of the pump cylinder 56 can be washed away effectively.

It is a matter of course that a clearance 48 between those portions of the pump plunger 2c and pump cylinder 56 which are above the oil dams 46 is made sufficiently narrow as compared with the clearance 49 mentioned previously and used for ejecting the pressure oil therefrom, so as to minimize the leakage of the pressure oil in the upward direction.

Figure 4:
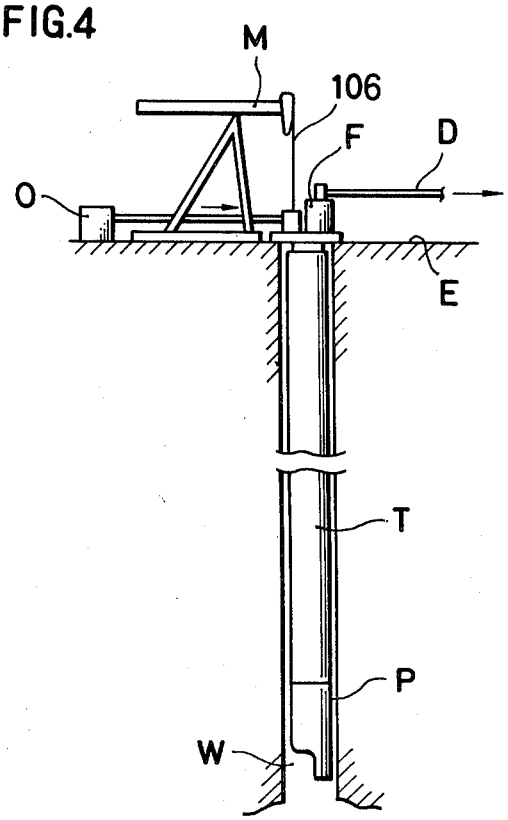
FIG. 4 is a longitudinal sectional view in schematic representation of another embodiment of a pumping system for oil production according to the present invention.

FIG. 4 schematically illustrates another mode of embodiment of a pumping system for oil production according to the present invention.

This embodiment is identical with the above-described embodiment in that a hydraulic unit O for sending out a high-pressure oil is set on the ground E, and in that a pump unit P for use in drawing up crude oil is set in the oil well W. However, the former is different from the latter in that, unlike the plunger in the pump unit P in the former, a plunger in the pump unit P in the latter is actuated not by the pressure oil from the hydraulic unit but by the mechanical power generated by a reciprocating mechanism M, which is set on the ground E, and applied thereto via a sucker rod 106.

Figure 5:
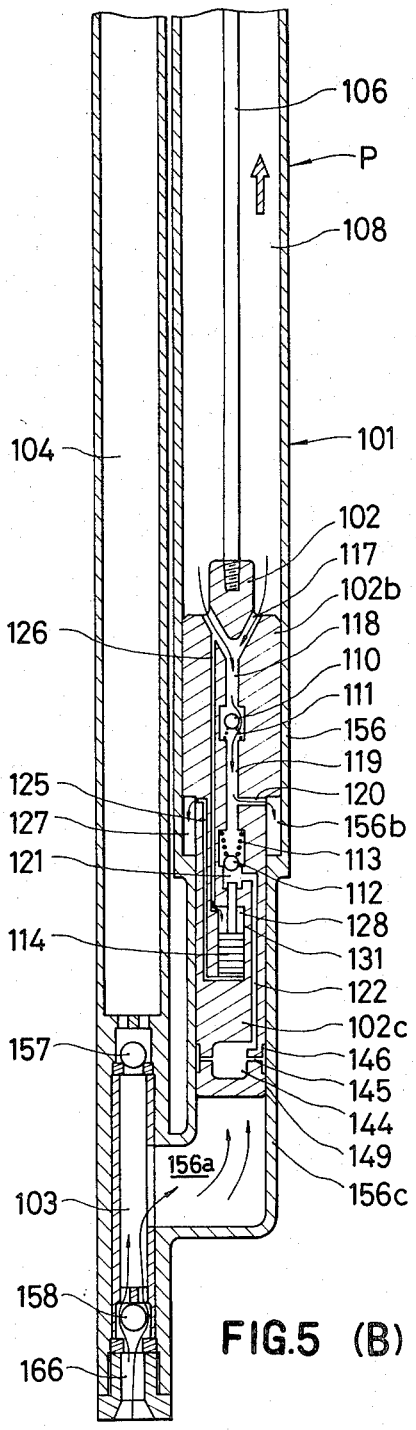
FIGS. 5A and 5B are longitudinal sectional views illustrating the details of a pump unit in the pumping system shown in FIG. 4, with respect to different strokes of a plunger provided therein.
Figure 5:
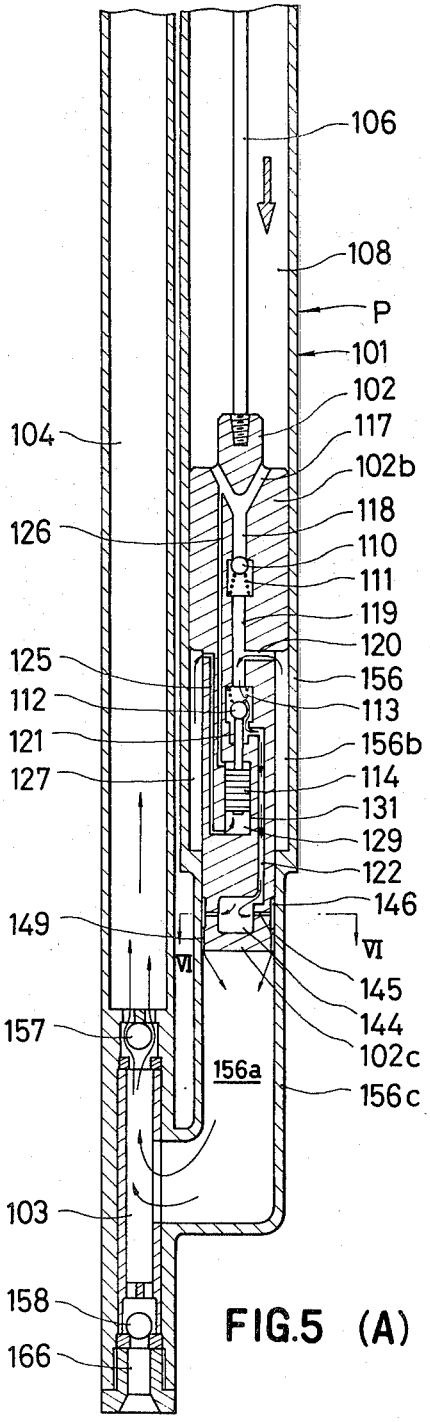

FIGS. 5A and 5B show the details of the pump unit P in the pumping system illustrated in FIG. 4. FIG. 5A shows the pump unit P with a main plunger 102 in a downward stroke, and FIG. 5B the same pump unit P with the main plunger 102 in an upward stroke. As shown in FIGS. 5A and 5B, the pump unit P consists of a pump casing 101 communicated at an upper end portion thereof with a tubing T, a main plunger 102 fitted in a pump cylinder 156, which is formed in the pump casing 101, so as to be moved reciprocatingly therein, and a crude oil discharge pipe 104 adapted to discharge therethrough the crude oil, which is sucked into a cylinder chamber 156a in the pump cylinder 156 by the reciprocating movements of the main plunger 102. The pump cylinder 156 has an upper cylinder portion 156b for sending the pressure oil, and a lower cylinder portion 156c of a smaller diameter communicated with the upper cylinder portion 156b and used to send crude oil under pressure. A valve chamber 103 is provided under the crude oil-sending cylinder portion 156c. A crude oil suction port 166 is provided under the valve chamber 103 via a suction valve 158. Above the valve chamber 103, a discharge valve 157 is provided, which is communicated with the crude oil discharge pipe 104.

The main plunger 102 consists of an upper plunger portion 102b for sending out the pressure oil, and a lower plunger portion 102c having a diameter smaller than that of the upper plunger portion 102b and used to send crude oil under pressure. The pressure oil-sending plunger portion 102b is slidably fitted in the pressure oil-sending cylinder portion 156b, and the crude oil-sending plunger portion 102c in the crude oil-sending cylinder portion 156c. The pressure oil-sending plunger portion 102b is provided therein with passages 117, 118 and 119 for guiding thereinto the pressure oil filling a main pressure oil passage 108, and a check valve 110, which is adapted to control the pressure oil in such a manner that the pressure oil flows in only one direction, and which is urged by a spring 111.

Figure 6:
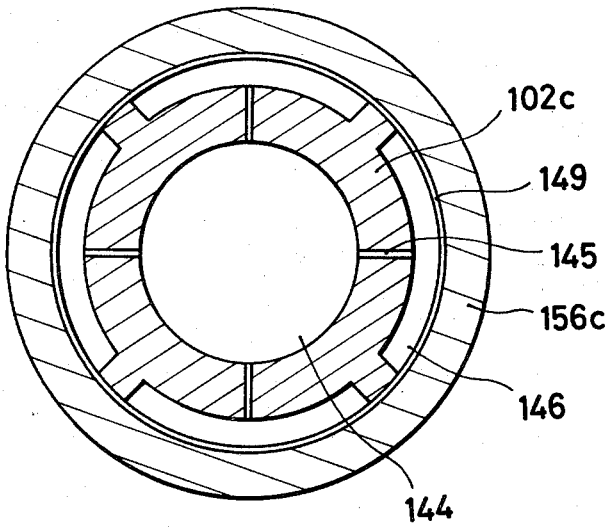
FIG. 6 is a sectional view taken along the line VI—VI in FIG. 5.

The crude oil-sending plunger portion 102c is provided therein with passages 125 and 122 for guiding thereinto the pressure oil in the pressure oil-introducing passages 120 and 119, and a space 127 formed between the pressure oil-sending cylinder portion 156b and crude oil-sending plunger portion 102c; a check valve 112, which is adpated to control the flow of pressure oil in the space 127, and which is urged by a spring 113; a pilot valve, i.e. a pilot piston 114 for controlling the function of the check valve 112; and a pilot cylinder 131 holding the pilot piston 114 therein. An oil reservoir 144 communicated with the passage 122 is provided under the crude oil-sending plunger portion 102c. Also, oil dams 146 are provided in the outer circumferential surface of a lower portion of the pump plunger 102c in such a manner that the oil dams 146 are spaced from one another as shown in FIG. 6. The oil dams 146 are communicated with the oil reservoir 144 via capillary 145 provided therebetween.

The main plunger 102 is connected at the upper end thereof to a sucker rod 106, which is connected at the upper end thereof to the reciprocating mechanism M shown in FIG. 4. Thus, the main plunger 102 is moved reciprocatingly in the vertical direction by the reciprocating mechanism M via the sucker rod 106.

The operation of the pump unit P will now be described with reference to the movements of the main plunger 102.

FIG. 5A shows the pump unit P with the main plunger 102 in the upper limit position and about to be moved downwardly. When the main plunger 102 is in such condition, a driving force, which corresponds to the sum of a resistance of the pressure oil working on the cross-sectional area of the space 127 and a discharge resistance of the crude oil working on the cross-sectional area of the crude oil-sending plunger portion 102*c*, and which is determined by the sum of the weight of the moving parts, such as the sucker rod 106, and that of the pressure oil in the main pressure oil passage 108, is applied to the main plunger 102. When the weight and sizes of each element are suitably set, the pressure of the pressure oil in the space 127 can be set to a suitable level. In such a pump unit P, the pressure oil in the space 127 is introduced into the lower chamber 129 in the pilot cylinder 131, so that the pressure in the lower chamber 129 overcomes that in the upper chamber 128. As a result, the pilot piston 114 is moved upwardly, and the check valve 112 is kept opened. As the main plunger 102 is downwardly moved, the pressure oil in the space 127 is introduced into the oil reservoir 144 through the passages 120, 119, 121 and 122. The pressure oil then flows into the oil dams 146 via the capillary 145, and is thereafter ejected from the clearance 149 along the inner circumferential surface of the crude oil-sending cylinder portion 156*c* into the cylinder chamber 156*a*.

Owing to the pressure oil thus ejected into the cylinder chamber 156*a*, the sand, silt and sludge deposited from the crude oil on the inner circumferential surface of the crude oil-sending cylinder portion 156*c* are washed away effectively. The ejected pressure oil is mixed in the crude oil in the cylinder chamber 156*a* in the crude oil-sending cylinder portion 156*c*, and the valve chamber 103 between the suction valve 158 and discharge valve 157. This allows the viscosity of the crude oil to be decreased, and the flow resistance of the crude oil above the suction valve 158 to be lowered. While the main plunger 102 is moved downwardly, the pressure oil in the space 127 is prevented by the check valve 110 from flowing backwardly toward the main pressure oil passage 108. While the main plunger 102 downwardly moved, the suction valve 158 is closed, and the discharge valve 157 opened. Therefore, the mixture of crude oil and pressure oil is sent to the well head assembly F on the ground via the crude discharge pipe 104.

On the other hand, when the main plunger 102 has reached the lower limit position to start being moved upwardly by the reciprocating mechanism M via the sucker rod 106, the pump unit P is in such state as shown in FIG. 5B. When the main plunger 102 begins to be moved upwardly, the pressure in the space 127 is decreased, so that the downward force applied to the pilot piston 114 owing to the pressure in the upper chamber 128 in the pilot cylinder 131, which is communicated with the pressure oil in the main pressure oil passage 108 via the passage 126, becomes greater than the upward force applied to the same. As a result, the pilot piston 114 is moved to the lower limit position. Thus, the pressure oil is prevented by the check valve 112 from flowing from the passage 119 into the passage 121. At the same time, the pressure oil in the main pressure oil passage 108 flows into the space 127 due to the difference between the pressures therein, and the space 127 is filled with the same pressure oil. In the meantime, the pressure in the valve chamber 103 is decreased, so that the suction valve 158 is opened with the discharge valve 157 closed. Accordingly, the crude oil in the oil well W is sucked into the pump unit.

The main plunger 102 thus continues to be upwardly moved. When the upward stroke of the main plunger 10 has reached the top dead position, the pump unit is in such condition as shown in FIG. 5A. The main plunger 102 then starts being moved downwardly again.

The pumping system according to the present invention having the above-described construction permits ejecting the pressure oil in accordance with the downward movement of the main plunger, from the circumferential portion of the lower end of the main plunger along the inner circumferential surface of the pump cylinder. Therefore, the sand, silt and sludge deposited from the heavy oil on the inner circumferential surface of the pump cylinder can be washed away effectively. Also, the outer circumferential surface of the pump plunger and the inner circumferential surface of the pump cylinder can be effectively prevented from being worn due to and corroded with the suspended matter, such as sand, silt and sludge. This allows the life of the pump body to be prolonged to a great extent. The pumping system according to the present invention further permits diluting the crude oil with the ejected pressure oil of a low viscosity to improve the fluidity thereof and carry out the crude oil above the ground very easily.

According to this pumping system, a high-pressure oil can be sent constantly into the pump body during a crude oil lifting operation to apply the pressure to the upper surface of the main plunger. Accordingly, when the plunger is actuated by the reciprocating mechanism set on the ground, via the sucker rod, not only the level of an output from the reciprocating mechanism but also the rigidity of the sucker rod can be reduced. Thus, the pumping system according to the present invention permits using a sucker rod of the same diameter in a deeper oil well as compared with a conventional pumping system of this kind.

What is claimed is:

1. A pumping system for oil production, comprising:

a hydraulic unit set on the ground and adapted to send out a high-pressure oil having a viscosity lower than that of crude oil to be drawn up; and a pump unit set in an oil well and adapted to draw up crude oil, said pump unit including, a pump cylinder, and a plunger adapted for reciprocating movement in said pump cylinder, said plunger being provided with an oil reservoir adapted to receive the high-pressure oil sent from said hydraulic unit thereto, the high-pressure oil causing said plunger to be reciprocatingly moved, a clearance formed between that portion of the outer circumferential surface of said plunger which is on the side of a cylinder chamber and the inner circumferential surface of said pump cylinder, said clearance communicating with said oil reservoir, the high-pressure oil being ejected from said clearance along the inner surface of said pump cylinder into said cylinder chamber while said plunger is reciprocatingly moved in said pump cylinder, wherein said oil reservoir is provided in the central portion of said plunger and communicated via a plurality of capillaries extending radially therefrom with said clearance provided outside the outer circumferential surface of said plunger, a hydraulic piston fixed to said plunger and adapted for reciprocating movement between a pair of opposing oil chambers, such that said high-pressure oil is received in each of said opposing oil chambers, and a pair of communicating lower chambers formed within said plunger, said lower chambers containing a slider adapted for reciprocating movement therebetween in response to said high-pressure oil from said oil chambers, the reciprocating movement of said slider causing the high-pressure oil to be pumped into said oil reservoir.

2. A pumping system for oil production according to claim 1, wherein the ejection of the high pressure oil from said clearance provided at the lower end of said plunger is carried out when said plunger is pressed toward said cylinger chamber.

* * * * *